United States Patent [19]

Auriemma

[11] 3,968,654

[45] July 13, 1976

[54] UNDERGROUND DRAIN PIPE COUPLING

[76] Inventor: Robert Sinbad Auriemma, R.D. No. 1, P.O. Box 104, Bethel, Pa. 19507

[22] Filed: Apr. 16, 1975

[21] Appl. No.: 568,398

[52] U.S. Cl. ..... 61/11; 61/14; 285/13; 285/419

[51] Int. Cl.[2] ..... E02B 11/00

[58] Field of Search ..... 61/11, 12, 13, 10, 14, 61/15; 285/13, 14, 373, 419

[56] References Cited

UNITED STATES PATENTS

| | | | |
|---|---|---|---|
| 926,532 | 6/1909 | Wilson | 285/419 X |
| 3,679,242 | 7/1972 | Hess | 61/10 |

*Primary Examiner*—Jacob Shapiro
*Attorney, Agent, or Firm*—Thomas Hooker

[57] ABSTRACT

A coupling for joining lengths of underground drainage pipe without inhibiting the flow of water into or along the pipe.

9 Claims, 3 Drawing Figures

UNDERGROUND DRAIN PIPE COUPLING

The invention relates to couplings for joining underground drainage pipe. Underground drainage pipes include troughs for draining away undesired water and openings permitting the flow of water from the ground through the walls of the pipe and into the trough for subsequent drainage. Lengths of drainage pipe are joined together by couplings to form desired lengths. Conventional drainage pipe couplings are shown in U.S. Pat. Nos. 2,029,920; 2,116,165; and 3,679,242.

The coupling of the present invention is easily and inexpensively manufactured and permits underground drainage lines of underground drainage pipe to be joined in the field rapidly without injury to the pipe. When coupled, the pipes are properly aligned relative to each other, thereby providing a continuous smooth flow surface on the interior of the pipe troughs. The coupling is perferably formed from a stiffly flexible material and includes a trough cover and a roof cover which may be flexed somewhat relative to each other, thereby facilitating preliminary positioning of the coupling on the end of a first pipe in approximate alignment with the pipe and subsequent seating of the coupling on the pipe in final alignment. A second pipe is then mounted on the other end of the coupling in a like manner.

The coupling extends longitudinally along both pipes sufficiently to orient them with respect to each other but does not interfere with flow openings extending through the walls of the pipe ajacent the pipe ends. This feature assures that the use of the coupling does not decrease the drainage capacity of a line of individual drainage pipes.

The roof and trough covers of the coupling are joined by a pair of connecting bands which overlie the wings preferably provided on the drainage pipes. The bands are spaced from the wings in order to reduce the possibility that the relatively fragil wings might be injured during assembly or burying of the drainage line.

Other objects and features of the invention will become apparent as the description proceeds, especially when taken in conjunction with the accompanying drawings illustrating the invention, of which there is one sheet.

IN THE DRAWINGS

Figure 1:
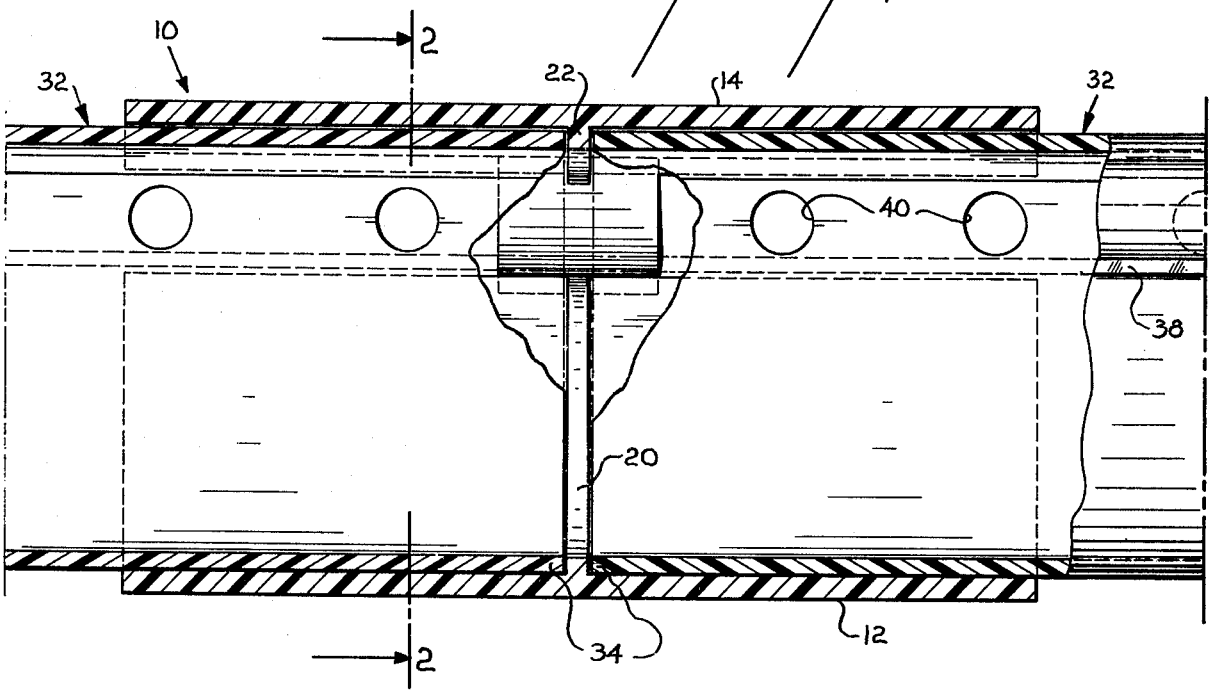
FIG. 1 is a vertical sectional view taken through a coupling for underground drainage pipe mounted on the ends of two lengths of pipe.
Figure 3:
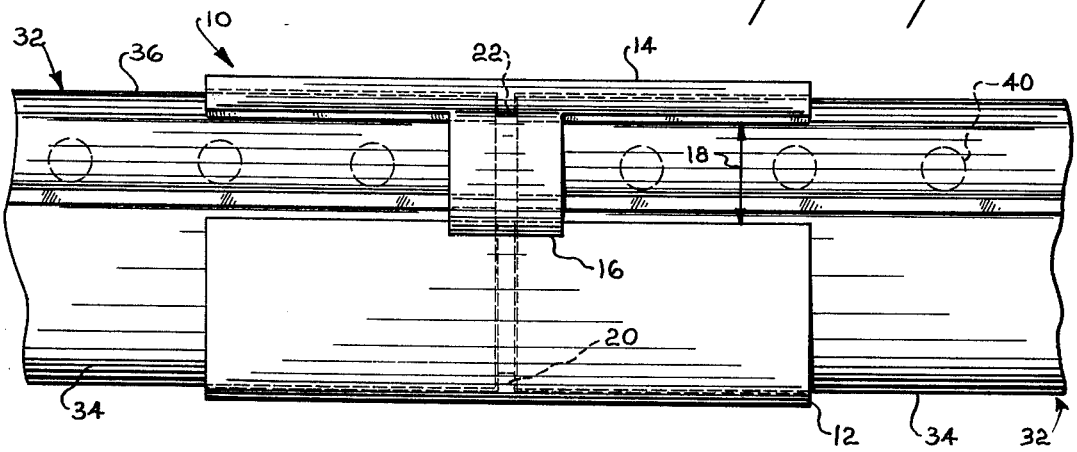
FIG. 3 is a side elevational view of the coupling and pipes taken along line 3—3 of FIG. 2.

Coupling 10 is preferably molded from a stiffly flexible plastic and includes an elongate seim-circular trough cover 12 and an elognate roof cover 14 which, as illustrated in FIGS. 1 and 3, overlies the trough cover 12. A pair of outwardly extending U-shaped connecting bands 16 join the two covers and hold them apart a distance along their length to define a drainage separation 18 between the covers. As illustrated in FIGS. 1 and 3, the connecting bands 16 are located centrally along the length of the coupling 10.

Figure 2:
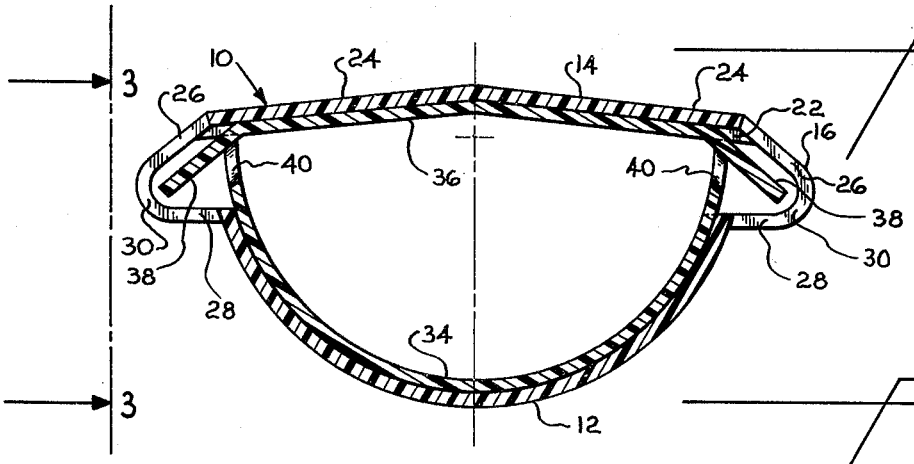
FIG. 2 is a sectional view taken along line 2—2 of FIG. 1.

A stop ridge 20 extends around the inner periphery of the trough cover 12 equidistant from the ends of the coupling. A similar stop ridge 22 extends along the inner periphery of the roof cover 14 and is also located equidistant from the ends of the coupling. As illustrated in FIG. 2, the roof cover 14 includes a pair of flat walls 24 which slope away from the center line of the coupling at a shallow angle.

Each band 16 includes a straight leg 26 extending outwardly from one side of the roof cover, a straight leg portion 28 extending outwardly from one lip of the trough cover, and a bend portion 30 joining the outer ends of the straight portions 26 and 28. The two bands 16 extend longitudinally to either side of the stop ridges 20 and 22, as illustrated in FIGS. 1 and 3.

The coupling 10 is used to connect lengths of underground drainage pipe 32, which may be of the type disclosed in my copending U.S. patent application entitled: "Underground Drainage Pipe", Ser. No. 529,236, filed Dec. 3, 1974. Each underground drainage pipe 32 includes semi-circular trough 34, a canted roof 36 which overlies and is integral with trough 34 and a pair of protecting wings 38 which extend outwardly and downwardly of the pipe from the junction between the roof and trough. Regularly spaced water intake holes 40 are formed through the thickness of the trough 34 to permit water to flow into the pipe and be drained away by flow along the trough. The wings 38 protect the drainage holes 40 from becoming clogged during usage. Coupling 10 joins together two lengths of pipe 32 so that, when coupled, the lengths form a continuous drainage line. Such drainage line may be buried and used to drain undesired water from the surrounding ground. Conventionally, these types of drainage lines are used in removing water from construction or highway sites where undesired water would normally collect without a drainage line.

Coupling 10 is mounted or attached to two drainage pipes by first fitting one end of the coupling over an end of one drainage pipe so that the coupling is in approximate alignment with the pipe. The trough cover 12 overlies trough 34 and the roof cover 14 overlies pipe roof 36. The coupling 10 is stiffly flexible, permitting limited flexing of the covers and U-bands during insertion. This flexing facilitates alignment of the coupling with respect to the pipe enabling workmen in the field to position the coupling on the end of the pipe quickly and easily. The flexibility of the coupling reduces the possibility of injury to the coupling or pipe during assembly. This is important because the pipes are joined together in the field under construction conditions where the utmost care may not be exercised.

The coupling 10 is moved onto the end of the first pipe 34 until the ends of the pipe trough and roof 34 and 36 abut the stop ridges 20 and 22. The trough and roof covers 12 and 14 have a close sliding fit with the pipe trough and roof and center the coupling on the pipe.

After the coupling has been positioned on the end of one pipe, a second length of pipe 32 is positioned into the open end of the coupling and is moved into the coupling as previously described until its lead end also seats against the stop ridges 20 and 22. These stop ridges are centrally located along the length of the coupling 10 to assure that both pipes are equally inserted into the coupling. If one pipe could be over inserted into the coupling, the other pipe would be under inserted with the result that the connection between the coupling and the other pipe would be undesirably weakened.

As illustrated in FIG. 1, the trough stop ridge 20 extends above the inner surface of the trough cover 12 a distance equal to the thickness of the troughs 34 of pipes 32. This assures that when the coupling joins two lengths of underground drain pipe the inner flow surface of the drainage path extending between the pipes is smooth. Turbulence is reduced. In practice, small solids may be flowed into the trough with the water entering the pipe through holes 40. The smooth inner flow surface prevents such solids from collecting in the line and impeding flow along the line.

The drainage holes 40 are spaced regularly along the length of the underground drain pipes to assure that when the pipes are burried, water in the surrounding soil is free to flow into the pipe at any point along the length of the pipe. The coupling 10 joins together two lengths of underground drain pipe without hindering the flow of water into the holes in the pipes, thus assuring that the resultant length of drainage pipe, when buried, will drain at an efficiency essentially the same as if the drainage line were formed from a continuous length of pipe 34. The drainage separation 18 between the trough and roof covers 12 and 14 extends the length of the coupling past the drainage holes 40 adjacent the ends of the pipes 34 joined by the coupling. This separation permits water to flow freely through the end most holes 40 while assuring that the coupling 10 extends sufficiently along the joined pipes to make a strong joint between the pipes and to align the pipes properly with respect to each other. Misalignment would result in turbulence as water flows from one pipe to the trough of the downstream pipe and result in solid particles in the water carried by the pipes collecting in a nest or bundle which would restrict flow.

The connecting bands 16 straddle the free ends of the pipes 34 and are spaced away from the end openings 40 in the pipes so that they do not effect the flow of water through these openings and into the troughs. The straight legs 26 of the bands extend from the roof cover over the ends of the wings 38 of adjacent pipes, thereby preventing potentially clogging solids from moving under the protective wings.

While I have illustrated and described a preferred embodiment of my invention, it is understood that this is capable of modification, and I therefore do not wish to be limited to the precise details set forth, but desire to avail myself of such changes and alternations as fall within the purview of the following claims.

What I claimed as my invention is:

1. An underground drainage pipe coupling formed of stiffly flexible material and including an elongate trough cover adapted to closely overlie the troughs of underground drain pipes joined by the coupling and having spaced lips, an elongate roof cover overlying the trough cover and adapted to closely overlie the roofs of underground drain pipes joined by the coupling, means centrally located on the sides of the coupling joining the lip of the trough cover and the adjacent edge of the roof cover, and drainage separations between said trough and roof covers to either side of said means, such separations permitting an unimpeded flow of water through water collection holes in the ends of the underground drain pipes joined by the coupling.

2. An underground drain pipe coupling as in claim 1 for joining underground drain pipes of the type having outwardly extending protective wings on either side of the pipe wherein said means comprise outwardly extending U-shaped bands each including a portion overlying the ends of the wings on underground drain pipes joined by the coupling.

3. An underground drain pipe coupling as in claim 2, wherein said stiffly flexible material is a plastic.

4. An underground drain pipe coupling comprising an elongated semi-circular trough cover, an elongate roof cover overlying the trough cover, said roof cover including a pair of longitudinally extending walls which slope away from each other at a shallow angle, stop ridges extending around the inner peripheries of both the trough cover and roof cover midway along the longitudinal lengths of said covers, and U-shaped connecting bands joining said covers midway along the longitudinal length of the coupling, each such band including a pair of straight portions extending outwardly from the covers and a bend portion joining the outer ends of the straight portions, said U-shaped connecting bands holding the covers apart from each other a distance along the length of the coupling to define drainage separations between the covers at the sides of the coupling.

5. An underground drain pipe coupling for mounting one end of an underground drainage pipe to another pipe or conduit, the coupling being formed of stiffly flexible material and including a trough cover and a roof cover overlying the trough cover at one end thereof, a connection for mounting on a pipe or conduit at the other end thereof, means joining said covers at opposite sides of the coupling away from said one end of the coupling to provide a separation between the covers at each side of the coupling extending from the means to said end of the coupling, and a stop ridge extending around the inner periphery of the trough cover adjacent said means.

6. An underground drain pipe coupling as in claim 1 including a centrally located stop ridge extending around the inner periphery of the trough cover.

7. An underground drain pipe coupling as in claim 1 for joining underground drain pipes of the type having outwardly extending protective wings on either side of the pipe wherein said means comprise bands extending outwardly of the covers and around the ends of the wings on underground drain pipes joined by the coupling.

8. An underground drain pipe coupling as in claim 7 including a stop ridge extending around the inner periphery of the trough cover adjacent said means.

9. An underground drain pipe as in claim 8 wherein said means extend to either side of the stop ridge to cover the joint between pipes joined by the coupling.

* * * * *